US012727681B2

(12) United States Patent
Defeng et al.

(10) Patent No.: US 12,727,681 B2
(45) Date of Patent: Sep. 8, 2026

(54) DETACHABLE TRAYS FOR CHILD SEATING PRODUCTS

(71) Applicant: Evenflo Company, Inc., Miamisburg, OH (US)

(72) Inventors: Yan Defeng, Miamisburg, OH (US); Gaylen Ercanbrack, Miamisburg, OH (US); Jessica Popelka, Miamisburg, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 160 days.

(21) Appl. No.: 18/742,586

(22) Filed: Jun. 13, 2024

(65) Prior Publication Data

US 2025/0380821 A1 Dec. 18, 2025

(51) Int. Cl.
*A47D 1/00* (2006.01)
*A47D 1/04* (2006.01)

(52) U.S. Cl.
CPC ..... *A47D 1/0085* (2017.05)

(58) Field of Classification Search
CPC .... A47D 1/0085; A47D 1/0081; A47D 1/004; A47D 1/006; B62B 3/007; B62B 2202/023; B62B 9/14; A47C 7/62
See application file for complete search history.

(56) References Cited

U.S. PATENT DOCUMENTS 1,428,916 A 9/1922 Snideman
3,212,814 A * 10/1965 Anderson ..... A47D 1/0083 297/162
4,288,123 A * 9/1981 Cone ..... A47D 1/0085 297/154
4,582,359 A 4/1986 Wise et al.
5,348,374 A 9/1994 Kuo
5,474,355 A * 12/1995 Lerner ..... A47D 1/002 297/411.31
5,527,090 A 6/1996 Cone
(Continued)

FOREIGN PATENT DOCUMENTS

CN 2442593 8/2001
CN 201432713 3/2010
(Continued)

OTHER PUBLICATIONS

Amazon, "Veer Veer Cruiser, Grey", Available online at: <https://www.amazon.com.au/Veer-CRU001-HGRAY-Cruiser-Grey/dp/B08LN5M57C>, Retrieved on May 31, 2024, 3 pages.
(Continued)

*Primary Examiner* — Shin H Kim
(74) *Attorney, Agent, or Firm* — Shook Hardy & Bacon L.L.P.

(57) ABSTRACT

Embodiments of the present disclosure are directed to a tray that may be detached from a first frame portion and a second frame portion of a child seating product using various tray decoupling mechanisms. The tray or the first and second frame portions may include a first latch, a second latch, a first latch opening, and a second latch opening. The first latch may be released via a first release mechanism and the second latch may be released using a second release mechanism, and the first release mechanism is different from the second release mechanism.

20 Claims, 9 Drawing Sheets

(56) References Cited

U.S. PATENT DOCUMENTS

| | | | | |
|---|---|---|---|---|
| 6,368,006 | B1 * | 4/2002 | Yang | B62B 9/26 403/93 |
| 6,416,124 | B1 | 7/2002 | Chen et al. | |
| 6,746,075 | B2 | 6/2004 | Cheng et al. | |
| 7,044,497 | B2 | 5/2006 | Hartenstine et al. | |
| 7,273,224 | B2 | 9/2007 | Wang | |
| 7,487,977 | B2 | 2/2009 | Johnson | |
| 7,922,244 | B2 | 4/2011 | Bearup | |
| 8,424,900 | B2 | 4/2013 | Ryan et al. | |
| 8,500,076 | B2 | 8/2013 | Lai | |
| 8,950,761 | B2 | 2/2015 | Chen | |
| 9,108,659 | B2 | 8/2015 | Sparling | |
| 9,302,695 | B2 | 4/2016 | Hartenstine et al. | |
| 9,560,919 | B2 | 2/2017 | Terhune et al. | |
| 9,986,850 | B2 | 6/2018 | Haut et al. | |
| 11,008,035 | B1 | 5/2021 | Walker | |
| 11,046,347 | B2 | 6/2021 | Merka et al. | |
| 11,097,761 | B2 | 8/2021 | Kim | |
| 11,465,664 | B1 | 10/2022 | Choi | |
| 11,589,682 | B2 | 2/2023 | Rosenthal | |
| 11,696,650 | B2 | 7/2023 | Li | |
| 2008/0290699 | A1 * | 11/2008 | Golias | A47D 1/004 297/16.1 |
| 2014/0125020 | A1 | 5/2014 | Sime et al. | |
| 2015/0296987 | A1 * | 10/2015 | Hondros | A47D 1/002 297/344.21 |
| 2016/0174727 | A1 * | 6/2016 | Haut | A47D 11/002 297/130 |
| 2017/0251826 | A1 * | 9/2017 | Sclare | A47D 1/008 |
| 2020/0128970 | A1 * | 4/2020 | Pujol | A47D 1/023 |
| 2020/0247453 | A1 * | 8/2020 | Gibson | B62B 3/022 |
| 2023/0055274 | A1 | 2/2023 | Anokhin et al. | |
| 2023/0068417 | A1 * | 3/2023 | Pacella | A47D 1/002 |
| 2023/0415806 | A1 | 12/2023 | Cui | |

FOREIGN PATENT DOCUMENTS

| | | |
|---|---|---|
| CN | 202449026 | 9/2012 |
| CN | 108016481 | 5/2018 |
| CN | 210364011 | 4/2020 |
| TW | M577278 | 5/2019 |

OTHER PUBLICATIONS

Burleigh Wagon, "Snack Tray", Available online at: <https://burleighwagon.com/products/snack-tray>, Retrieved on May 31, 2024, 3 pages.

Chicco, "Bravo Stroller Child Tray", Available online at: <https://www.chiccousa.com/shop-our-products/accessories/bravo-stroller-child-tray/00060141000070.html>, Retrieved on May 31, 2024, 2 pages.

Delta Children, "Jeep Plastic Child Center Console Snack Tray For Jeep Wagon Models", Available online at: <https://www.deltachildren.com/products/jeep-plastic-child-center-console-snack-tray-by-delta-children-for-jeep-wagon-models>, Retrieved on May 31, 2024, 2 pages.

Tactical Baby Gear, "Switchback Drink & Snack Tray", Available online at: <https://tacticalbabygear.com/products/switchback-drink-snack-tray>, Retrieved on May 31, 2024, 2 pages.

* cited by examiner

DETACHABLE TRAYS FOR CHILD SEATING PRODUCTS

BACKGROUND

Child seating products such as wagons, strollers, and high chairs can be used as seating for children. Child seating products often include trays to place, hold, or temporarily store the child occupant's food, toys, and the like. Child seating products also frequently need cleaned due to the child occupant eating snacks or a meal in the child seating product and leaving messes, particularly messes on the tray. Further, the tray may be unnecessary if the child occupant is not eating. The tray may be detachable for space-saving reasons, such as to allow more efficient collapse of the child seating product. In designing a detachable tray, the tray may be removed to allow for proper cleaning, increased range of motion of a child occupant, and to provide space savings.

BRIEF DESCRIPTION OF THE DRAWINGS

The present disclosure is described in detail below with reference to these figures.

DETAILED DESCRIPTION

Figure 1:
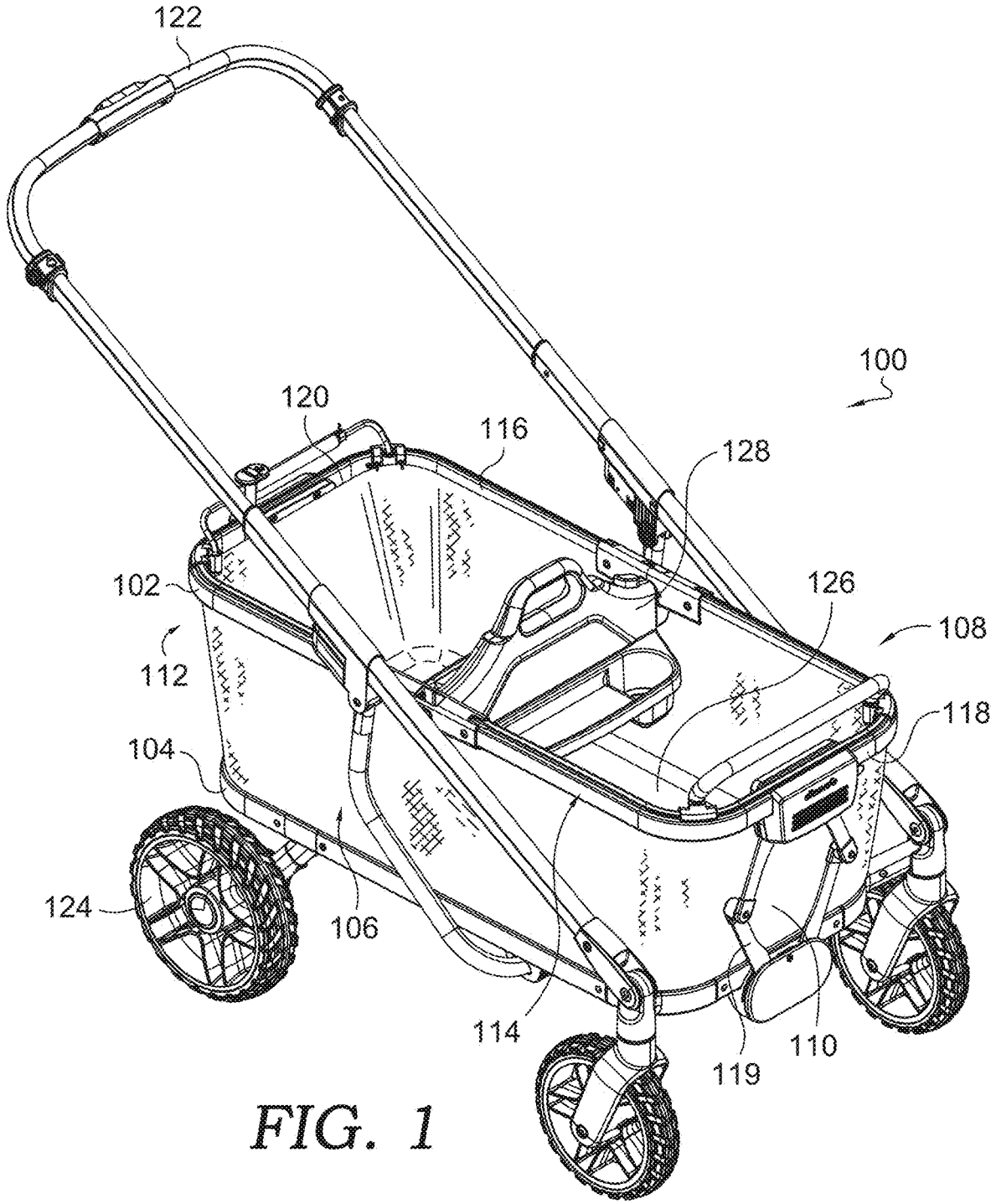
FIG. 1 illustrates a perspective view of an example child seating product with a detachable tray in accordance with embodiments disclosed herein.

As briefly discussed above, child seating products often include trays. Generally, users may be able to wipe down the tray after eating. However, the tray may not be cleaned as thoroughly when it cannot be detached from the child seating product. Further, the child may experience a restricted range of motion while the tray is attached. Additionally, the tray may prevent efficient collapse of the child seating product, reducing the amount of space that may be saved from collapse. As such, it can be useful for a child seating product to incorporate a release mechanism for removing the tray from the child seating product to provide a more efficient child seating product.

This detailed description is related to tray that may be detachably coupled to a child seating product or apparatus (e.g., a wagon, stroller, high chair) that may be detached by the user to allow easy cleaning, increased range of movement for the child occupant in the child seating product, and increased space savings. In some examples, a tray extends between first and second frame portions on the child seating product and is detachably coupled to a child seating product by coupling a first latch and a second latch on the tray and/or frame portions to a first latch opening and a second latch opening on the tray and/or frame portions. The tray may be decoupled from the child seating product via various tray decoupling mechanisms described herein. In some examples, the first latch and the second latch each move in opposite directions relative to each other to detach the tray from the child seating product, and in other examples, the first latch and the second latch move in the same direction relative to each other to detach the tray from the child seating product. The first latch may be uncoupled from the first latch opening using a first release mechanism and the second latch may be uncoupled from the second latch opening using a second release mechanism, where the first release mechanism is different (i.e., is not a mirror image of) from the second release mechanism. A single release button, when actuated, causes the first and second release mechanisms (i.e., uncoupling of the first latch and the second latch) to occur. A single release button may make detaching the tray easier for the user. In aspects, the release button is off-center of the tray, which reduces the possibility of unintentional release, such as by the child occupant.

In some aspects, the first latch and the second latch are each components of the tray that couple to the first latch opening and second latch openings positioned on the first frame portion and the second frame portion of the child seating product. In these examples, the first latch and the second latch may move in opposite directions relative to each other. In other aspects, the first latch and the second latch are each components of the first frame portion and the second frame portion, and couple to the first latch opening and second latch opening in the tray. In either of these examples, the first latch and the second latch may move in opposite directions relative to each other. In other aspects, each of the tray and the child seating product has a latch and a latch opening. In other words, the first latch and the second latch opening are components of the tray, and the first latch opening and the second latch are positioned on the first frame portion and the second frame portion. In these examples, the first latch and the second latch may move in the same direction relative to each other.

Turning now to FIG. 1, an example child seating product is provided. FIG. 1 illustrates a wagon 100 as an example child seating product. The wagon 100 may generally comprise a frame. The frame may include a top frame 102 and a bottom frame 104 that generally defines a first side 106, a second side 108 generally opposite the first side 106, a front side 110, and a rear side 112 generally opposite the front side 110. The top frame 102 may include a first frame portion 114 and a second frame portion 116 opposite the first frame portion 114. In instances, the top frame 102 includes a front frame portion 118 and a rear frame portion 120, each extending between the first frame portion 114 and the second frame portion 116. The bottom frame 104 of the wagon 100 may have frame portions corresponding to those of the top frame 102. The top frame 102 and the bottom frame 104 of the wagon 100 may be coupled to each other by one or more intermediate frame portions 119, which may be movable to allow the top frame 102 and the bottom frame 104 to collapse towards each other for storage. Additionally, the first frame portion 114 and the second frame portion 116 may be portions of a unitary structure or may be separately formed structures secured together either directly or indirectly via other components, such as the front frame portion 118 and the rear frame portion 120. The frame of the wagon 100 may be at least partially coupled to soft goods or other materials to enclose the wagon 100.

The wagon 100 may include a handle 122. The handle 122 is arranged to extend towards the rear of the wagon 100 in this example and may act as a push handle. In other aspects, the handle 122 may be arranged to extend beyond the front of the wagon 100 so that it may be used as a pull handle. In some aspects, the handle 122 may be adjustable so that it is movable between the front side 110 and the rear side 112 of the wagon 100 and useable for push or pull. The handle 122 may be movable relative to the frame through sliding, rotating, telescoping, pivoting, and the like. The handle 122 may be composed of two side handle portions and a central handle portion that connects the two side handle portions and provides a central area where a user would grasp the handle 122. In other examples, the handle 122 may comprise two side handle portions that are not joined together.

The frame may be coupled to wheels 124 allowing movement of the wagon 100. The wheels 124 are located at least partially under the frame such that the wheels support the weight of the frame. While four wheels 124 are shown, it will be appreciated that additional or fewer wheels 124 may be provided. For example, the wagon 100 may have a three-wheel configuration. The wheels 124 may be uniform in size or there may be differences in wheel sizes. For example, the rear wheels 124 may be larger in diameter than the front wheels 124.

Between the front side 110 and the rear side 112 of the frame may be a seating area 126 configured to accommodate a person, such as a child. The seating area 126 is generally positioned above the wheels 124. The seating area 126, may include soft goods, such as textiles and cushions, to aid in occupant comfort. The seating area 126 may also include a harness, lap belt, or other features not illustrated. In aspects, the wagon 100 may have more than one seating area 126. For example, a second seating area 126 may be located opposite of the seating area 126. The wagon 100 may also include a canopy, which is not shown so as to avoid obstructing view of various components of the wagon 100. The canopy may provide weather protection for the occupant, such as UV protection from the sun. In aspects, the canopy may be collapsible and/or detachable.

The wagon 100 includes a tray 128. The tray 128 may provide an eating surface for an occupant, such as a child. The tray 128 may allow the occupant to place and store items (e.g., snacks, toys, drinks) within the wagon 100. The tray 128 may extend between and be detachably coupled to the first frame portion 114 and the second frame portion 116. When the tray 128 is detached from the wagon 100, the occupant may have an increased range of motion such that the tray 128 does not restrict the occupant to solely the seating area 126. For example, when the tray 128 is detached, the occupant may easily move positions from the seating area 126 to another area of the wagon 100 such as to play with another child occupant in the wagon 100. Additionally, when the tray 128 is detached from the wagon 100, the seating area 126 may be usable to accommodate larger occupants and/or larger items. Further details of the tray 128 and how it may be detached are further described with respect to FIGS. 4A-8.

In some embodiments, the wagon 100 is collapsible between a collapsed position and a use position. The collapsed position may be a position in which the wagon 100 could be stored in the back of a vehicle or a closet, for example. The tray 128 may be detached from the wagon 100 to improve the efficiency of the collapsibility of the wagon 100. The use position may be a position in which the wagon 100 could be pushed or pulled carrying an occupant, such as a child. In other examples, the wagon 100 is not collapsible.

Figure 2:
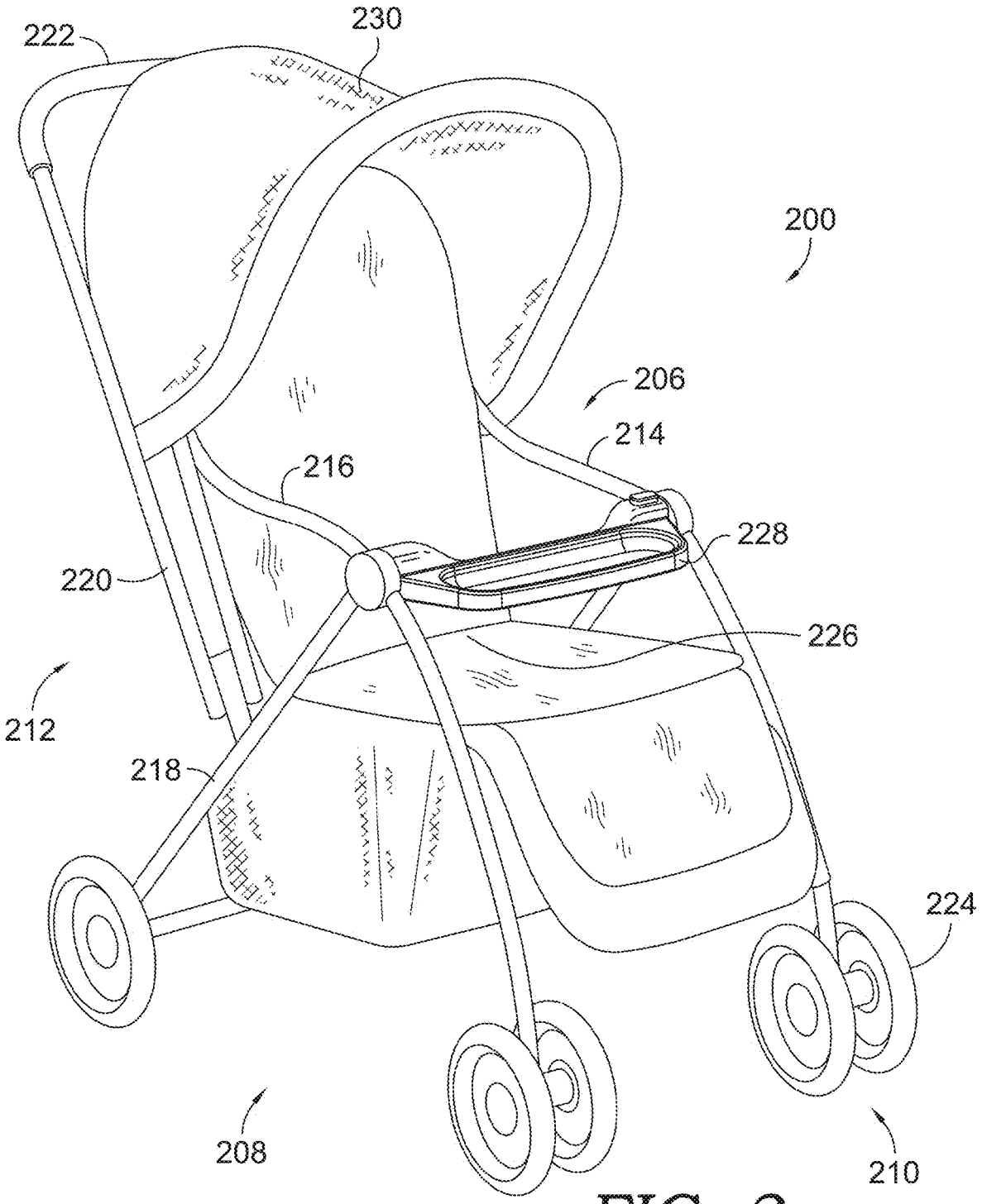
FIG. 2 illustrates a perspective view of another example child seating product with a detachable tray in accordance with embodiments disclosed herein.

Now turning to FIG. 2, an example child seating product is provided. FIG. 2 illustrates a stroller 200 as another example child seating product that fall within aspects of this disclosure. The stroller 200 may generally comprise a frame. The frame generally defines a first side 206, a second side 208 generally opposite the first side 206, a front side 210, and a rear side 212 generally opposite the front side 210. The frame may include a first frame portion 214 and a second frame portion 216 opposite the first frame portion 214. The first frame portion 214 and the second frame portion 216 are spaced apart on opposite sides of a seating area 226 of the stroller 200. In instances, the frame may include additional frame portions, such as an angled frame portion 218 and a rear frame portion 220. The first frame portion 214 and the second frame portion 216 may be portions of a unitary structure or may be separately formed structures secured together either directly or indirectly via other components, such as the angled frame portion 218 and the rear frame portion 220. The stroller 200 includes a tray 228 that is detachable from the first frame portion 214 and the second frame portion 216, which can provide an eating surface for an occupant of the stroller 200. The stroller 200 may also include one or more features of the wagon 100 of FIG. 1, such as a handle 222, wheels 224, the seating area 226, and a canopy 230.

Figure 3:
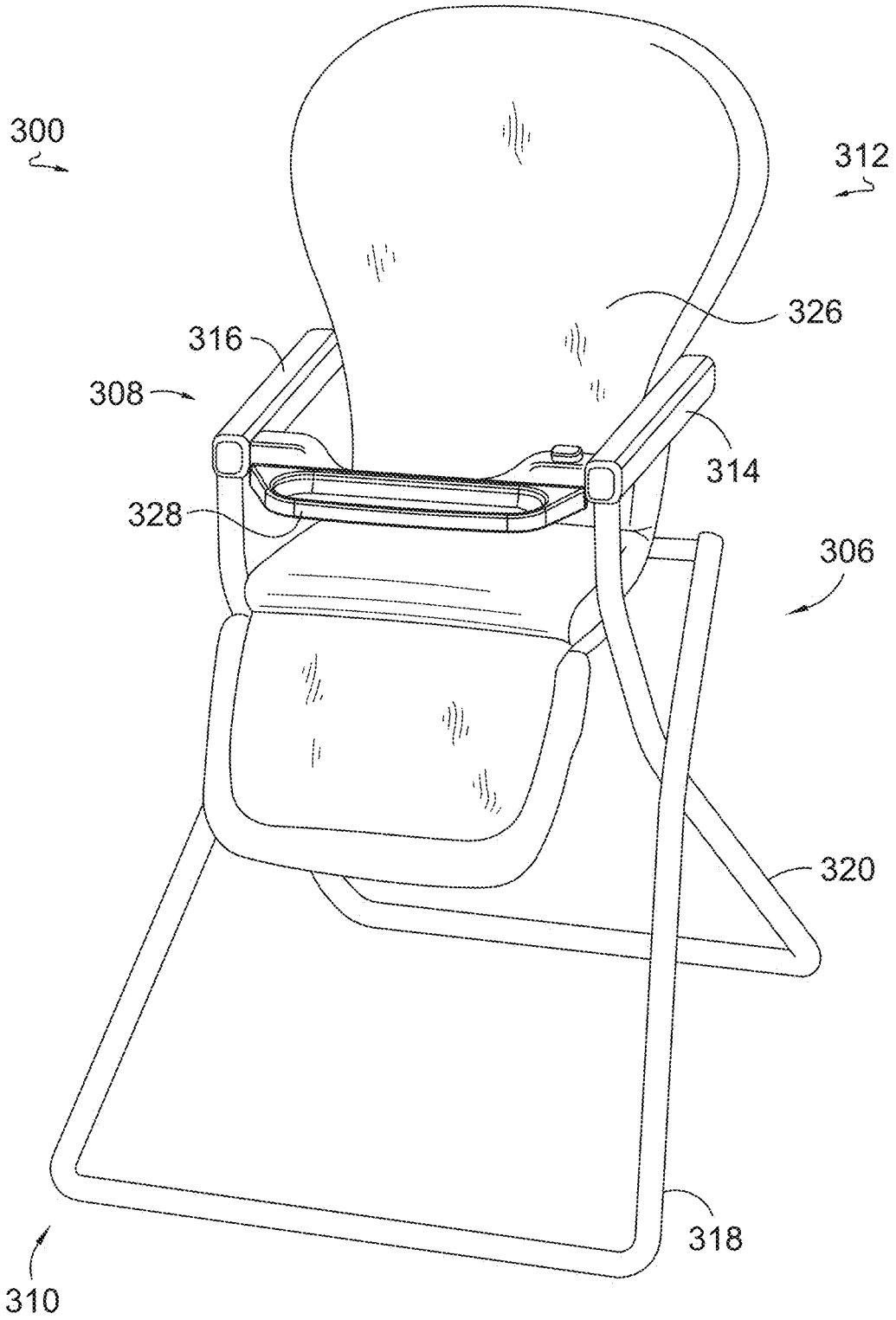
FIG. 3 illustrates a perspective view of another example child seating product with a detachable tray in accordance with embodiments disclosed herein.

Turning now to FIG. 3, an example child seating product is provided. FIG. 3 illustrates a high chair 300 as an example child seating product. The high chair 300 may generally comprise a frame. The frame generally defines a first side 306, a second side 308 generally opposite the first side 306, a front side 310, and a rear side 312 generally opposite the front side 310. The frame may include a first frame portion 314 and a second frame portion 316 opposite the first frame portion 314. In aspects, the first frame portion 314 is a first arm of the high chair 300 and the second frame portion 316 is a second arm of the high chair 300. In instances, the frame may include additional frame portions, such as a front angled frame portion 318 and a rear angled frame portion 320. The first frame portion 314 and the second frame portion 316 may be portions of a unitary structure or may be separately formed structures secured together either directly or indirectly via other components, such as the front angled frame portion 318 and the rear angled frame portion 320. The high chair 300 includes a tray 328 detachably coupled to the first frame portion 314 and the second frame portion 316, which can provide an eating surface for an occupant of the high chair 300. The high chair 300 may include one or more features or accessories of the wagon 100 of FIG. 1 or the stroller 200 of FIG. 2, such as a seating area 326.

Figure 4A:
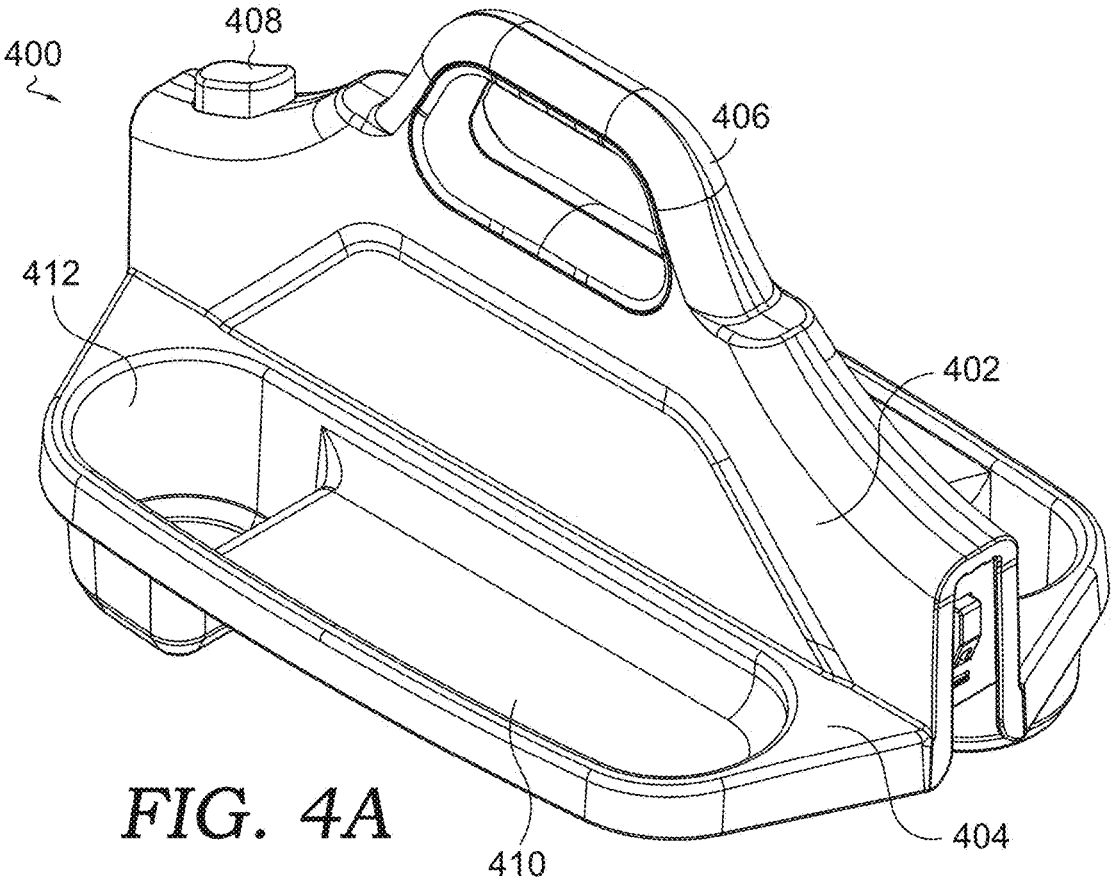
FIGS. 4A-4B illustrate various views of a detachable tray in accordance with embodiments disclosed herein.

Turning now to FIG. 4A, a detachable tray 400 suitable for use with any of the preceding child seating products (e.g., the wagon 100, the stroller 200, and the high chair 300) is provided. In some aspects, the tray 400 may include a body 402 and a tray area 404 extending outward from the body 402. The body 402 of the tray 400 may include a handle 406 and a release button 408. A top surface of the body 402 of the tray 400 may be contoured to facilitate grasping of each of the handle 406 and the release button 408 by the user when attaching or detaching the tray 400 from the child seating product. For example, by providing a contour between the handle and the release button 408, the user's thumb may more easily interact with each of the handle 406 and the release button 408. In other aspects, the tray 400 does not include the body 402, and instead includes one tray area 404 and the release button 408. For example, in stroller embodiments (e.g., the tray 228 coupled to the stroller 200 of FIG. 2) and in high chair embodiments (e.g., the tray 328 coupled to the high chair 300 of FIG. 3), it may be beneficial to have an open tray area 404 suitable for serving the child occupant a complete meal. In such aspects, the tray 400 may include the handle 406 positioned along an edge of the tray 400. The tray 400 may be made of one or more suitable materials such as plastic, silicone, metal, and the like. For example, the tray area 404 may comprise a combination of plastic and silicone to increase ease of cleaning.

In some embodiments, the tray 400 includes the handle 406. The handle 406 may be configured to be grasped by a user when detaching the tray 400 from the child seating product. While the handle 406 is shown at a center of the tray 400, the handle 406 may be placed at a side of the tray 400. In some aspects, the body 402 of the tray 400 may have more than one handle 406. For example, the tray 400 may include two handles, with one on each side of the tray 400. In some examples, the handle may have a different shape than that shown in FIG. 4A. For example, the underside of the handle 406 (i.e., the area the user's palm would come into contact with during grasping) may include contours such that the user has increased comfort when grasping the handle 406.

In example aspects, the tray 400 has only one release button (release button 408) that may be operative to completely release the tray 400 from the child seating product as further described. For example, the release button 408 of the tray 400 may be a single button that may be downwardly pressed by the user to detach each side of the tray 400 from the child seating product. In aspects, the release button 408 being downwardly pressed initiates a first release mechanism of the tray 400. In other aspects, the release button 408 may be configured to perform a different movement to initiate the first release mechanism (e.g., sliding, rotating, pulling, tilting, or a combination of these). In some examples, the release button 408 is off-center so that it is located more towards one side of the tray 400. For example, the handle 406 may be placed at the center of the tray and the release button 408 is placed on one side of the tray 400 as shown in FIG. 4A, such that the handle 406 may be grasped while removing the tray 400. Positioning the release button 408 away from the handle 406 makes it less likely that the child occupant will decouple the tray 400 without adult assistance. Further, the handle 406 may be grasped (e.g., to reposition the child seating product) without the possibility of causing the tray 400 to decouple from the child seating product. In other examples, the release button 408 may be located at the center of the tray 400 or at any other location of the body 402 of the tray 400. For example, the release button 408 may be placed at an underside of the handle 406 such that the release button 408 may be pressed simultaneously when the user grabs the handle 406.

In some embodiments, the tray area 404 may perpendicularly extend from the body 402 such that the tray area 404 is generally level, and in other embodiments, the tray 400 includes the tray area 404 and does not include the body 402. The tray area 404 may include a recessed tray area 410 that is recessed relative to the tray area 404. The recessed tray area 410 may be used by the occupant to place items such as snacks, meals, toys, drawing utensils, tablets, and the like. The recessed tray area 410 is recessed such that the items within the recessed tray area 410 will not easily dislodge from the tray 400 upon movement of the child seating product, but instead, for example, may roll around within the recessed tray area 410. In some examples, the tray area 404 may further include a rounded recessed area 412 that may serve as a cup holder to hold beverage containers (e.g., sippy cups, to-go beverages, juice boxes, and the like) or otherwise receive additional items for placement (e.g., drawing utensils, snacks, toys, and the like). For example, the child occupant may place a beverage in the rounded recessed area 412 while eating food positioned in the recessed tray area 410.

Figure 4B:
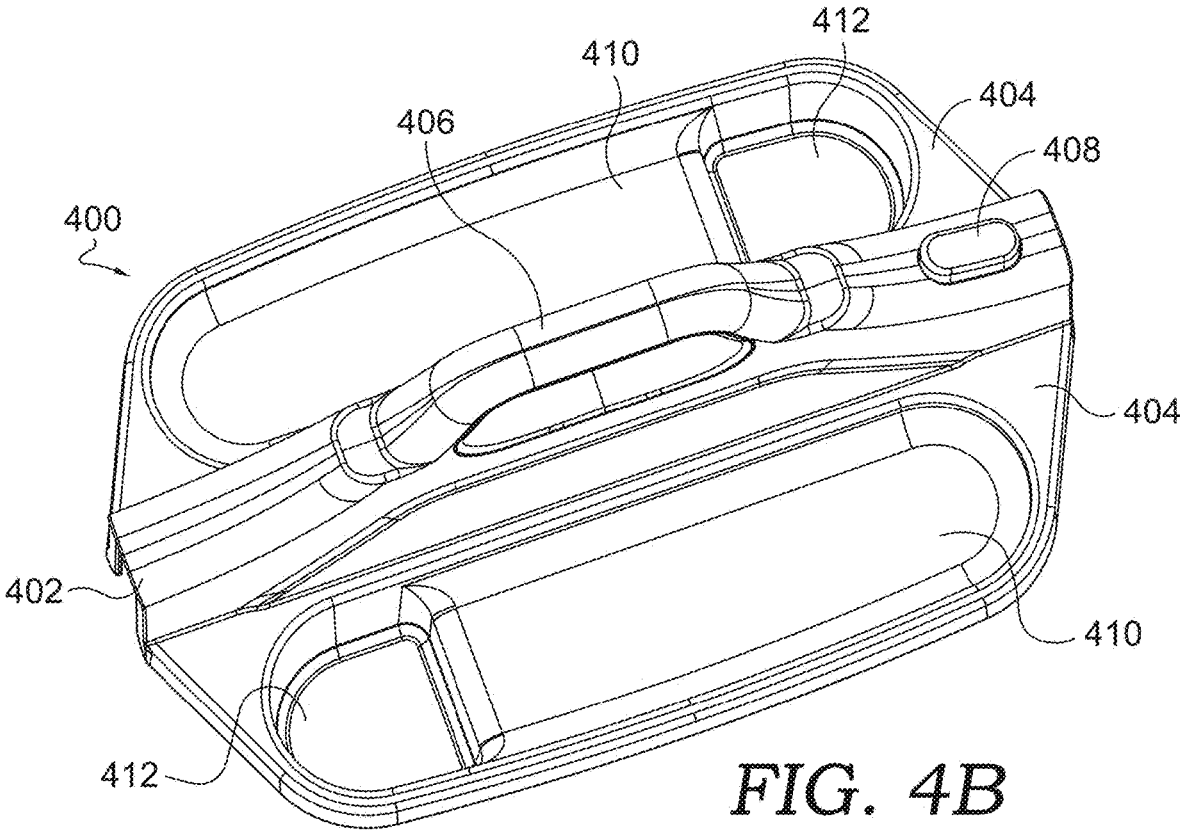

Turning now to FIG. 4B, the tray 400 is shown from an overhead perspective. In some aspects, the tray 400 may include more than one tray area 404, as shown in FIG. 4B. For example, in wagon examples (e.g., the wagon 100 of FIG. 1), there may be two seating areas such that two child occupants may be seated in the wagon, facing each other. In this example, it may be beneficial to have one tray area 404 extending from one side of the body 402 of the tray 400 for one child occupant as well as a second tray area 404 extending from the other side of the body 402 of the tray 400 for a second child occupant. In other aspects, the tray 400 may have a single tray area 404. For example, in some child seating products, such as strollers and high chairs, there is a single child occupant or multiple child occupants sit beside each other (e.g., side-by-side double strollers). In these examples, there is less need to have a second tray area 404 on the other side of the body 402 of the tray 400.

Figure 5:
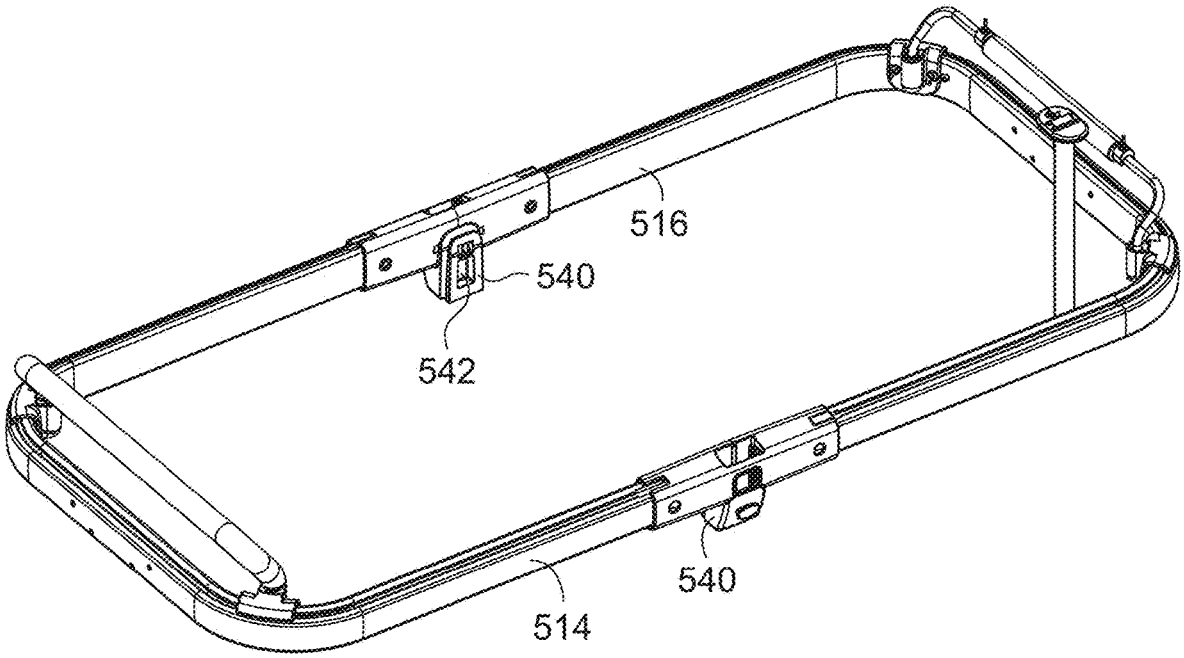
FIG. 5 illustrates a partial perspective view of a frame of the example child seating product of FIG. 1 in accordance with embodiments disclosed herein.

Turning now to FIG. 5, a portion of a frame of a child seating product is provided to illustrate how a tray (e.g., tray 400) may be attached to the child seating product in some aspects. FIG. 5 illustrates the frame of a wagon, such as the wagon 100 of FIG. 1; however, the discussion of the frame is likewise applicable to the child seating products discussed in FIGS. 2-3 (e.g., the stroller 200 and the high chair 300). The frame includes a first frame portion 514 and a second frame portion 516 (e.g., the first frame portion 114 and the second frame portion 116 of FIG. 1, the first frame portion 214 and the second frame portion 216 of FIG. 2, the first frame portion 314 and the second frame portion 316 of FIG. 3). In examples, the first frame portion 514 and the second frame portion 516 opposite the first frame portion 514 are substantially parallel to one another.

A tray (e.g., the tray 400 of FIG. 4A-4B) may be coupled to the first frame portion 514 and the second frame portion 516. In some aspects, each of the first frame portion 514 and the second frame portion 516 include a mounting component 540. In some aspects, each of the mounting components 540 may include one or more latch openings 542 configured to receive one or more latches of the tray (e.g., the tray 400 of FIGS. 4A-4B). In other aspects, the mounting component 540 includes one or more latches configured to couple to corresponding latch openings on the tray. In aspects, one of the mounting components 540 may house the latch opening 542 and the other mounting component 540 may house a latch to be received by a latch opening on the tray.

The mounting components 540 may be located at various locations along the first frame portion 514 and the second frame portion 516. In aspects, the mounting components 540 are aligned with each other such that a first mounting component 540 faces a second mounting component 540. In wagon examples (e.g., the wagon 100 of FIG. 1), it may be beneficial to place the mounting components 540 towards a center of the first frame portion 514 and a center of the second frame portion 516, such that the tray is spaced equally between a front frame portion and a rear frame portion (e.g., the front frame portion 118 and the rear frame portion 120 of FIG. 1). In stroller examples (e.g., the stroller 200 of FIG. 2) and in high chair examples (e.g., the high chair 300 of FIG. 3), mounting components may be located at or near a terminal end of the first frame portion 514 and a terminal end the second frame portion 516 such as to allow the child occupant enough space to sit comfortably without the tray making contact with or unduly restricting the motion of the child occupant.

In some aspects, the frame may not include the mounting components 540, and the tray (e.g., the tray 400 of FIG. 4) may be coupled directly to the first frame portion 514 and the second frame portion 516 at a first mounting point and a second mounting point. The first mounting point and the second mounting point may be located at the same or similar locations of the mounting components 540, as described above. In aspects, the first mounting point and the second mounting point may be aligned with one another such that the first mounting point faces the second mounting point. In some examples, the latch openings 542 may be formed within each of the first frame portion 514 at the first mounting location and the second frame portion 516 at the second mounting location. In some examples, each of the first frame portion 514 and the second frame portion 516 may house latches (e.g., at the first mounting point and the second mounting point) configured to couple to corresponding latch openings on the tray, as shown and described with respect to FIG. 8. In some aspects, one of the first frame portion 514 or the second frame portion 516 houses a latch configured to couple to a corresponding latch opening on the tray, and the other of the first frame portion 514 or the second frame portion 516 houses a latch opening configured to couple to a corresponding latch within the tray (e.g., a latch is present at the first pointing point on the first frame portion 514 and a latch opening is present at the second mounting point on the second frame portion 516), as shown and described with respect to FIG. 7.

Figure 6A:
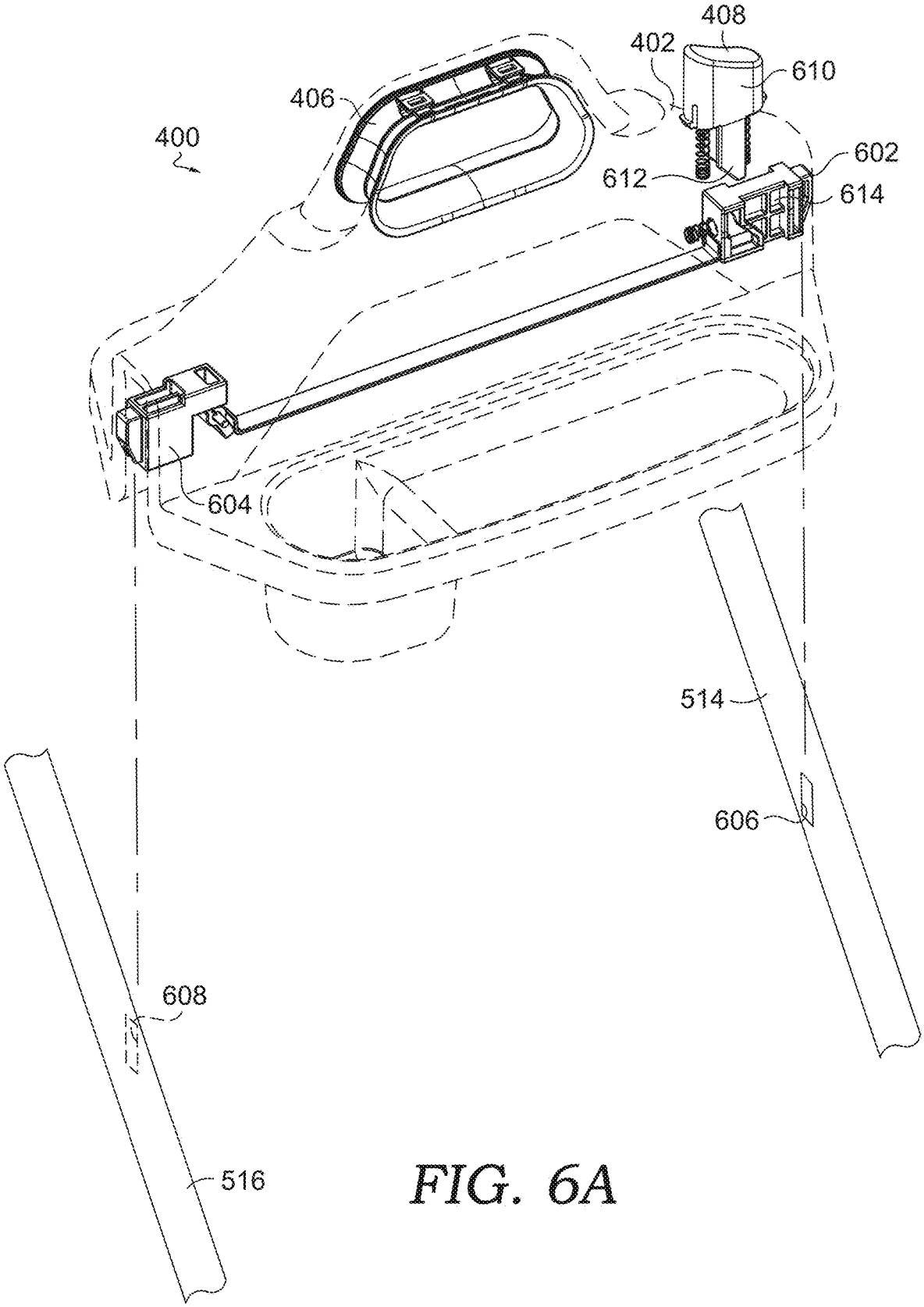
FIGS. 6A-6B illustrate perspective views of an example tray release mechanism for the tray of FIGS. 4A-4B in accordance with embodiments disclosed herein.

Turning now to FIG. 6A, an illustration of an example tray decoupling mechanism is provided. In this example, the tray 400 (e.g., the tray 400 of FIG. 4) may house a first latch 602 and a second latch 604, while the first frame portion 514 houses a first latch opening 606 and the second frame portion 516 houses a second latch opening 608. In aspects, the tray decoupling mechanism may include a first release mechanism and a second release mechanism, and the first release mechanism may be different (i.e., not a mirror image of) from the second release mechanism. While the result of each of the first release mechanism and the second release mechanism may be similar or the same (i.e., the tray 400 decouples from the first frame portion 514 and the second frame portion 516), the geometry, arrangement, and/or function of the subcomponents of each of the first release mechanism and the second release mechanism are different.

The tray 400 may be detachably coupled to the first frame portion 514 and the second frame portion 516. The tray 400 may include the first latch 602 that couples to the first latch opening 606 on the first frame portion 514 and a second latch 604 that couples to the second latch opening 608 on the second frame portion 516. As shown in FIG. 6A, the first release mechanism may be initiated by a user pressing the release button 408 downward. The release button 408 may be spring loaded such that the release button 408 is biased to remain in an extended position corresponding to when the first latch 602 is coupled to the first latch opening 606, and the bias may be overcome by a user exerting a downward force on the release button 408. The release button 408 may include a push portion 610 and an angled portion 612. When the push portion 610 is pressed by the user, the angled portion 612 may slide within an indentation or cavity 614 of the first latch 602. As shown in FIG. 6A, the angled portion 612 may have a beveled edge, and in other aspects the angled portion 612 has a chamfered edge. A longer portion of the bevel or chamfer may be located proximate to the first latch 602 such that the angled portion may easily slide within the cavity 614.

Figure 6B:
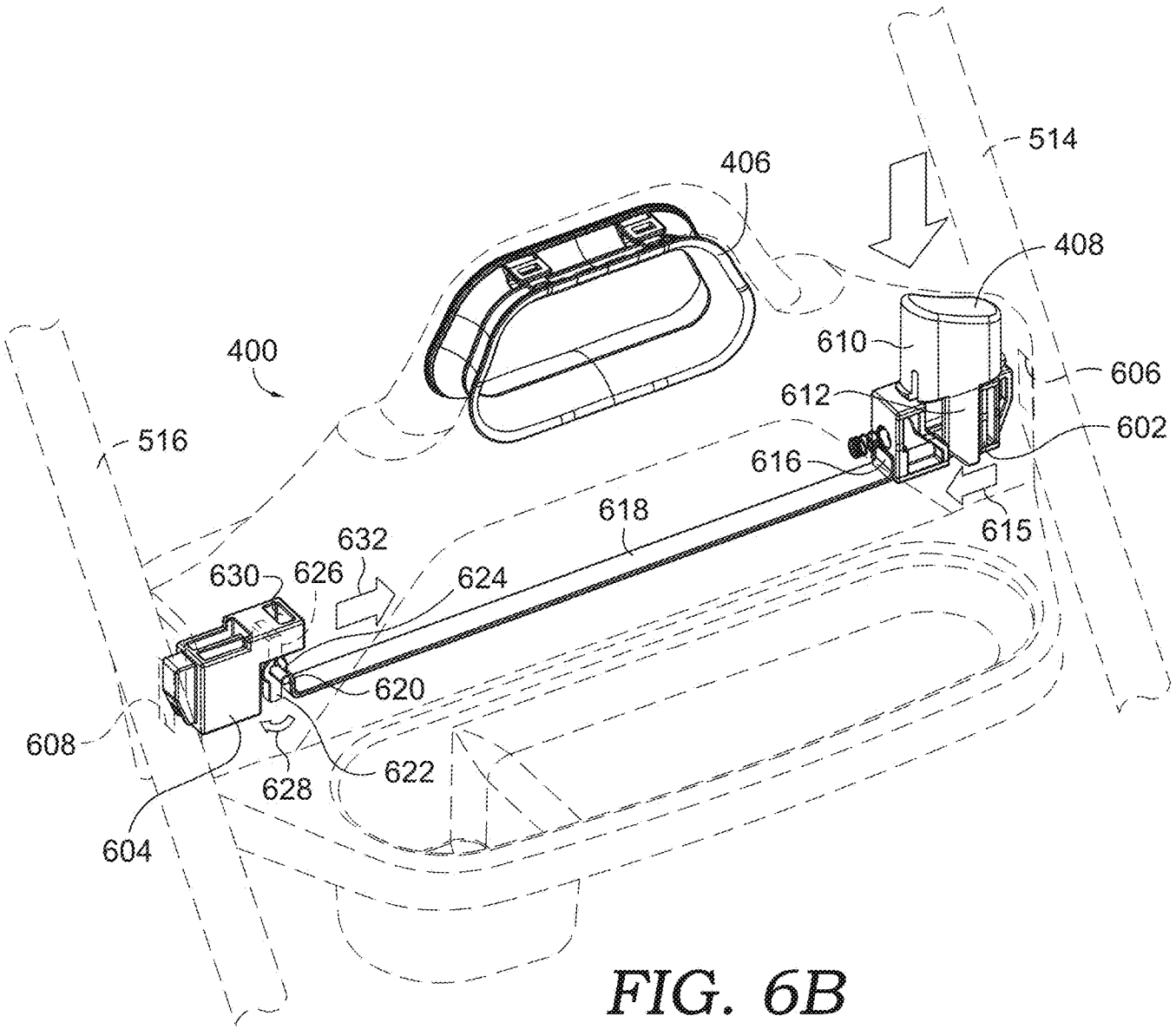

Turning now to FIG. 6B, an illustration of the example tray decoupling mechanism proceeding is provided. The first release mechanism includes uncoupling the first latch 602 from the first latch opening 606. The angled portion 612 sliding within the cavity 614 of the first latch 602, as shown in FIG. 6A, causes the first latch 602 to move in the direction of a first arrow 615 and exit the first latch opening 606. The second release mechanism includes uncoupling the second latch 604 from the second latch opening 608. The first latch 602 moving in the direction of the first arrow 615 causes the first latch 602 to abut a first end 616 of a linkage 618, causing the linkage 618 to move in the direction of the first arrow 615. The linkage 618 moving in the direction of the first arrow 615 causes a second end 620 of the linkage 618 to abut a first end 622 of a rotating piece 624, causing the rotating piece 624 to rotate in the direction of a second arrow 628. The rotating piece 624 rotates in the direction of the second arrow 628 to cause a second end 626 of the rotating piece 624 to abut an inner wall 630 of the second latch 604. The second end 626 of the rotating piece 624 abuts the inner wall 630 to cause the second latch 604 to move in the direction of a third arrow 632 and exit the second latch opening 608. The direction of the first arrow 615 and the third arrow 632 are in opposite directions such that the first latch 602 and the second latch 604 each move in opposite directions relative to each other.

Once each of the first latch 602 and the second latch 604 have exited the first latch opening 606 on the first frame portion 514 and the second latch opening 608 on the second frame portion 516, the tray 400 may be removed from the child seating product. In aspects, the user may grasp the handle 406 while simultaneously pressing the release button 408. Once each of the first latch 602 and the second latch 604 exit the first latch opening 606 and the second latch opening 608, the user may pull upward on the handle 406 to remove the tray 400 from the child seating product.

Figure 7:
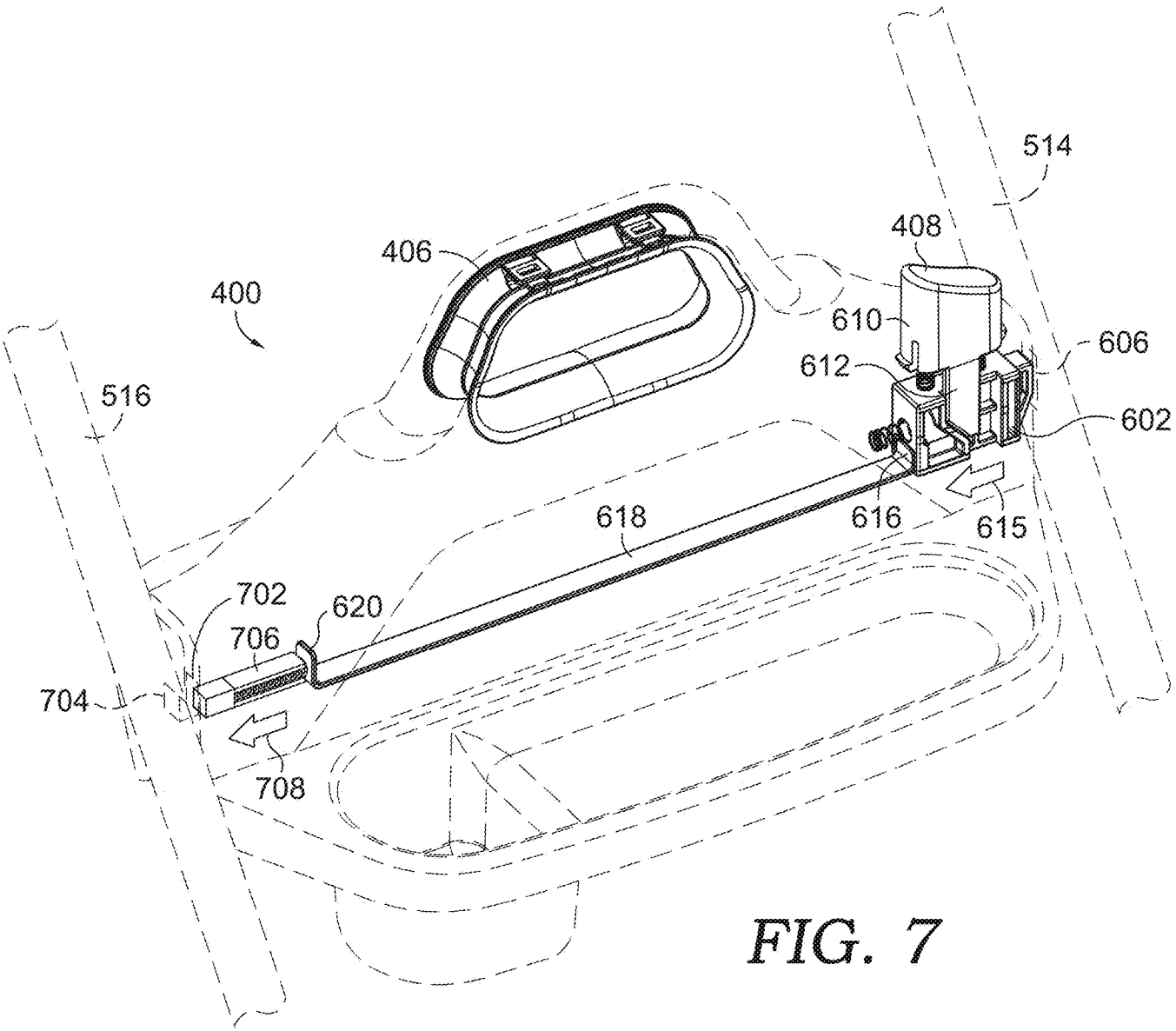
FIG. 7 illustrates a perspective view of another tray release mechanism for the tray of FIGS. 4A-4B in accordance with embodiments disclosed herein.

Turning now to FIG. 7, an illustration of another example tray decoupling mechanism is provided where the tray 400 and the frame portions 514 and 516 each have an opening and latch component. The tray 400 may be detachably coupled to a first frame portion 514 and a second frame portion 516. In aspects, the tray decoupling mechanism may include a first release mechanism and a second release mechanism, and the first release mechanism may be different (i.e., not a mirror image of) from the second release mechanism, as described with respect to FIG. 6A.

The tray 400 may include the first latch 602 and the first frame portion 514 may include the first latch opening 606, as described with respect to FIGS. 6A-6B. In contrast to FIGS. 6A-6B, the tray 400 may include a second latch opening 702 configured to receive a second latch 704 positioned on the second frame portion 516. In this example, one latch (i.e., the first latch 602) is a feature of the tray 400 while another latch (i.e., the second latch 704) is a component of the second frame portion 516. In some aspects, the second latch 704 on the second frame portion 516 may be movable such that one or more surfaces of the second latch 704 be moved to sit flush with the second frame portion 516 during the tray decoupling mechanism. For example, the second latch 704 may be hingedly movable such that the second latch 704 hinges to move into the second frame portion 516 when the tray is being decoupled. In another example, the second latch 704 may move linearly in retracting into the second frame portion 516.

Although not identical, the tray decoupling mechanism in FIG. 7 may be similar to that of FIGS. 6A and 6B in that the tray decoupling mechanism in FIG. 7 includes a first release mechanism and a second release mechanism that are different (i.e., not mirror images) from each other. The first release mechanism in FIG. 7 to release the first latch 602 from the first latch opening 606 may be the same as the first release mechanism described with respect to FIGS. 6A and 6B. That is, the first release mechanism in FIG. 7 may be initiated by the user pressing the push portion 610 of the release button 408 downward. The angled portion 612 slides within the cavity of the first latch 602 causing the first latch 602 to move in the direction of the first arrow 615 and causing the first latch 602 to exit the first latch opening 606, as described with respect to FIGS. 6A-6B.

Also similar to FIGS. 6A-6B, the first and second release mechanisms in FIG. 7 may be connected via linkage 618. That is, when the first latch 602 moves in the direction of the first arrow 615, the first latch 602 pushes the first end 616 of the linkage 618, causing the linkage 618 to move in the direction of the first arrow 615. However, the second release mechanism in FIG. 7 may be different than that in FIGS. 6A and 6B because this side of the tray 700 includes a latch opening instead of another latch. In some aspects, the second end 620 of the linkage 618 may be coupled to a plunger 706, and in other aspects, the second end 620 of the linkage 618 may abut the plunger 706 once the linkage 618 moves in the direction of the first arrow 615. The second end 620 of the linkage 618 moving in the direction of the first arrow 615 causes the plunger 706 to move in the direction of a second arrow 708 and abut the second latch 704 of the second frame portion 516. The plunger 706 abutting the second latch 704 causes the second latch 704 to exit the second latch opening 702 of the tray 400 in the direction of the second arrow 708. The plunger 706 may be spring loaded such that a force causing the second latch 704 to exit the second latch opening 702 is increased. The direction of the first arrow 615 and the second arrow 708 are in the same direction such that the first latch 602 and the second latch 604 each move in the same direction relative to each other.

Figure 8:
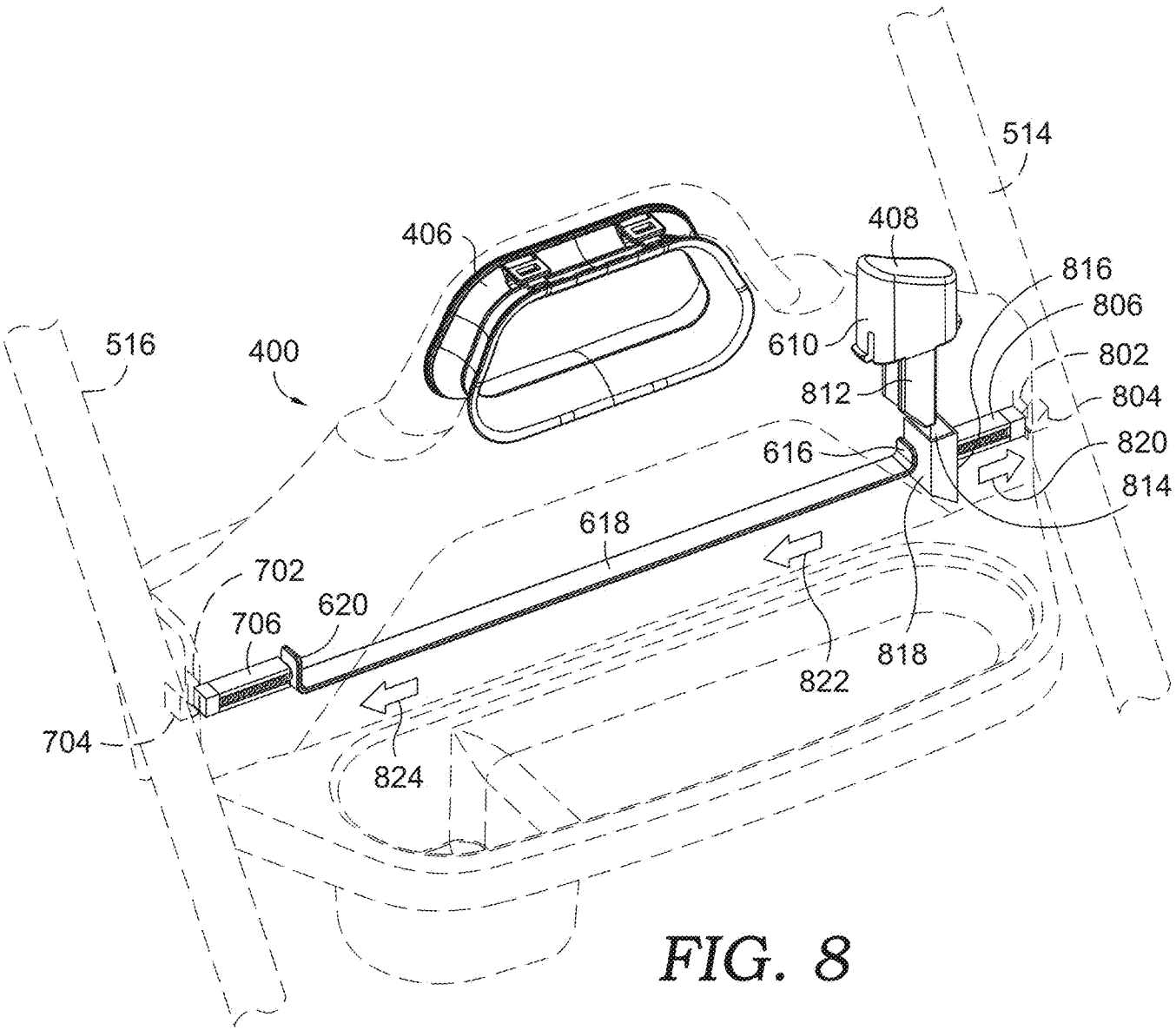
FIG. 8 illustrates a perspective view of another tray release mechanism for the tray of FIGS. 4A-4B in accordance with embodiments disclosed herein.

Turning now to FIG. 8, an illustration of another example tray decoupling mechanism is provided where the frame portions 514 and 516 each have latches and the tray 400 has latch openings. The tray 400 may be detachably coupled to a first frame portion 514 and a second frame portion 516. In contrast to FIGS. 6A-6B and FIG. 7, the tray 400 includes a first latch opening 802 and a second latch opening 702, and the first frame portion 514 includes a first latch 804 and the second frame portion 516 includes the second latch 704. The first latch 804 is configured to couple to the first latch opening 802 of the tray 400, and the second latch 704 is configured to couple to the second latch opening 702 of the tray 400. The first latch 804 and the second latch 704 may have one or more features described with respect to the second latch 704 of FIG. 7. The tray decoupling mechanism may include a first release mechanism and a second release mechanism that are different (e.g., not a mirror image of) from each other.

The first release mechanism may be initiated by a user pressing the push portion 610 of the release button 408 downward, and proceeds until the first latch 804 has exited the first latch opening 802. Pressing the push portion 610 of the release button 408 causes an angled portion 812 to slide within an expandable cavity 814. The angled portion 812 may have a beveled edge, and in other aspects the angled portion 812 has a chamfered edge. In some aspects, a longer portion of the bevel or chamfer edge may be located proximate to the first latch 804, and in other aspects, a longer portion of the bevel or chamfer edge may be located proximate to the linkage 618, such that the angled portion may easily slide within the expandable cavity 814.

The expandable cavity 814 may expand when the angled portion 812 slides within the expandable cavity 814 such that a first side wall 816 moves in the direction of a first arrow 820 and a second side wall 818 moves in the direction of a second arrow 822. In some aspects, a first plunger 806 may be coupled to an opposite side of the first side wall 816, and in other aspects, the first side wall 816 may abut the first plunger 806 during expansion of the expandable cavity 814 to cause the first plunger 806 to move in the direction of the first arrow 820. During the first release mechanism, the angled portion 812 slides within the expandable cavity 814 to cause the first side wall 816 to move in the direction of the first arrow 820 and causes the first plunger 806 to move in the direction of the first arrow 820. The first plunger 806 moves in the direction of the first arrow 820 to abut the first latch 804 and cause the first latch 804 to exit the first latch opening 802 of the tray 400.

The second release mechanism may be initiated by the first latch 804 exiting the first latch opening 802 and causing the first end 616 of the linkage 618 to move in the direction of the second arrow 822. In some aspects, the first end 616 of the linkage 618 is coupled to an opposite side of the second side wall 818, and in other aspects, the first end 616 of the linkage 618 abuts the opposite side of the second side wall 818 once the second side wall 818 moves in the direction of the second arrow 822 during expansion of the expandable cavity 814. The second side wall 818 expanding may cause the linkage 618 to move in the direction of the second arrow 822. In some aspects, the second end 620 of the linkage 618 may be coupled to the second plunger 706 (i.e., the plunger 706 of FIG. 7), and in other aspects, the second end 620 of the linkage 618 may abut the second plunger 706 once the linkage 618 moves in the direction of the second arrow 822. When the linkage moves in the direction of the second arrow 822, the second end 620 of the linkage 618 and the second plunger 706 move in the direction of a third arrow 824. As described with respect to FIG. 7, the second plunger 706 moves in the direction of the third arrow 824 to abut the second latch 704 and cause the second latch 704 to exit the second latch opening 702 of the tray 400. The direction of the first arrow 820 and the third arrow 824 are in opposite directions such that the first latch 804 and the second latch 704 each move in an opposite direction relative to each other in contrast to the mechanisms in FIGS. 6A-B and 7.

The following clauses represent example embodiments of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A child seating product comprising: a frame having a first frame portion and a second frame portion spaced apart from the first frame portion; a tray detachably coupled to the first frame portion and the second frame portion; a tray decoupling mechanism comprising: a first latch coupling the tray to the first frame portion; a second latch coupling the tray to the second frame portion, wherein, when the tray is in a coupled configuration, the tray extends between the first frame portion and the second frame portion; and a single button on the tray and positioned offset from a center of the tray that, when pushed, causes the first latch and the second latch to each move in opposite directions relative to each other, allowing the tray to uncouple from the first frame portion and the second frame portion.

Clause 2. The child seating product of clause 1, wherein the first latch is positioned on a first side of the tray and the second latch is positioned on a second side of the tray, and wherein a first latch opening is positioned on the first frame portion and a second latch opening is positioned on the second frame portion.

Clause 3. The child seating product of clauses 1 or 2, wherein the single button comprises a push portion and an angled portion, wherein the push portion is depressed to cause the angled portion to slide within the first latch, moving the first latch inward toward the center of the tray to an uncoupled position.

Clause 4. The child seating product of any of clauses 1-3, wherein the tray comprises a linkage extending between the first latch and the second latch, wherein inward movement of the first latch moves the linkage laterally, which causes the second latch to be moved to an uncoupled position.

Clause 5. The child seating product of clause 3, wherein the tray further comprises a rotating piece having a first end that abuts the linkage and a second end that, when rotated due to lateral movement of the linkage, abuts the second latch to move the second latch inward toward the center of the tray toward an uncoupled position.

Clause 6. The child seating product of clause 1, wherein the first latch is positioned on the first frame portion and the second latch is positioned on the second frame portion, and wherein a first latch opening is positioned on a first side of the tray and a second latch opening is positioned on a second side of the tray.

Clause 7. The child seating product of clause 6, wherein the tray comprises a first plunger configured to slide laterally, wherein when the single button is depressed, the first plunger moves towards the first latch positioned within the first latch opening of the tray to push the first latch out of the first latch opening.

Clause 8. The child seating product of clauses 6 or 7, wherein the tray comprises a linkage that moves away from the first latch when the single button is depressed, wherein the linkage abuts a second plunger causing the second plunger to move the second latch out of the second latch opening.

Clause 9. The child seating product of any of clauses 1-8, wherein the children's seating product is a wagon.

Clause 10. A child seating product comprising: a frame having a first frame portion and a second frame portion spaced apart from the first frame portion; a tray detachably coupled to the first frame portion and the second frame portion; a tray decoupling mechanism comprising: a first latch coupling the tray to the first frame portion; a second latch coupling the tray to the second frame portion, wherein, when the tray is in a coupled configuration, the tray extends between the first frame portion and the second frame portion; and a single button on the tray that, when pushed, causes the first latch and the second latch to each move in opposite directions relative to each other, allowing the tray to uncouple from the first frame portion and the second frame portion; wherein the first latch is releasable via a first release mechanism and the second latch is releasable via a second release mechanism, wherein the first release mechanism is different from the second release mechanism.

Clause 11. The child seating product of clause 10, wherein the first latch is positioned on a first side of the tray and the second latch is positioned on a second side of the tray, and wherein a first latch opening is positioned on the first frame portion and a second latch opening is positioned on the second frame portion.

Clause 12. The child seating product of clauses 10 or 11, wherein the single button comprises a push portion and an angled portion, wherein the first release mechanism comprises depressing the push portion to cause the angled portion to slide within the first latch and move the first latch inward towards a center of the tray to an uncoupled position.

Clause 13. The child seating product of any of clauses 10-12, wherein the tray comprises a linkage extending between the first latch and the second latch, and wherein inward movement of the first latch causes the second release mechanism to occur, the second release mechanism comprising: the linkage moving laterally and abutting a first end of a rotating piece; the first end of the rotating piece rotating to cause a second end of the rotating piece to rotate towards a wall of the second latch and push against the wall of the second latch to move the second latch inward toward the center of the tray to an uncoupled position.

Clause 14. The child seating product of clause 10, wherein the first latch is positioned on the first frame portion and the second latch is positioned on the second frame portion, and wherein a first latch opening is positioned on a first side of the tray and a second latch opening is positioned on a second side of the tray.

Clause 15. The child seating product of clause 10 or 14, wherein the tray comprises a first plunger configured to slide laterally, wherein the first release mechanism comprises depressing the single button, to cause the first plunger to move toward the first latch positioned within the first latch opening of the tray to move the first latch out of the first latch opening to an uncoupled position.

Clause 16. The child seating product of clause 10 or 14-15, wherein the tray comprises a linkage extending between the first latch opening and the second latch opening, and wherein actuation of the first release mechanism causes the second release mechanism to occur, the second release mechanism comprising: the linkage moving laterally and abutting a second plunger; and the second plunger moving toward the second latch to move the second latch out of the second latch opening of the tray.

Clause 17. A child seating product comprising: a frame having a first frame portion and a second frame portion spaced apart from the first frame portion; a tray detachably coupled to the first frame portion and the second frame portion; a tray decoupling mechanism comprising: a first latch configured to detachably couple to a first latch opening, coupling the tray to the first frame portion; a second latch positioned on the second frame portion and configured to detachably couple to a second latch opening of the tray, coupling the tray to the second frame portion, and wherein, when the tray is in a coupled configuration, the tray extends between the first frame portion and the second frame portion; and a single button on the tray that, when pushed, causes the first latch and the second latch to each move in a same direction relative to each other, allowing the tray to uncouple from the first frame portion and the second frame portion.

Clause 18. The child seating product of clause 17, wherein the first latch opening is positioned on the first frame portion, and wherein the first latch is positioned on a first side of the tray, and wherein the second latch opening is positioned on a second side of the tray.

Clause 19. The child seating product of clauses 17-18, wherein the single button comprises a push portion and an angled portion, and when the push portion is depressed, the angled portion slides within the first latch to move the first latch inward toward a center of the tray and out of the second latch opening to an uncoupled position.

Clause 20. The child seating product of any of clauses 17-19, wherein the tray further comprises a linkage that moves away from the first latch when the push portion is depressed, causing a plunger to move towards the second latch and move the second latch out of the second latch opening of the tray to an uncoupled position.

Many different arrangements of the various components depicted, as well as components not shown, are possible without departing from the scope of the claims below. Embodiments in this disclosure are described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

In the preceding detailed description, reference is made to the accompanying drawings which form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the preceding detailed description is not to be taken in the limiting sense, and the scope of embodiments is defined by the appended claims and their equivalents.

What is claimed is:

1. A child seating product comprising:

a frame having a first frame portion and a second frame portion spaced apart from the first frame portion;

a tray detachably coupled to the first frame portion and the second frame portion;

a tray decoupling mechanism comprising:

a first latch coupling the tray to the first frame portion;

a second latch coupling the tray to the second frame portion, wherein, when the tray is in a coupled configuration, the tray extends between the first frame portion and the second frame portion; and a single button on the tray and positioned offset from a center of the tray that, when pushed, causes the first latch and the second latch to each move in opposite directions relative to each other, allowing the tray to uncouple from the first frame portion and the second frame portion.

2. The child seating product of claim 1, wherein the first latch is positioned on a first side of the tray and the second latch is positioned on a second side of the tray, and wherein a first latch opening is positioned on the first frame portion and a second latch opening is positioned on the second frame portion.

3. The child seating product of claim 2, wherein the single button comprises a push portion and an angled portion, wherein the push portion is depressed to cause the angled portion to slide within the first latch, moving the first latch inward toward the center of the tray to an uncoupled position.

4. The child seating product of claim 3, wherein the tray comprises a linkage extending between the first latch and the second latch, wherein inward movement of the first latch moves the linkage laterally, which causes the second latch to be moved to an uncoupled position.

5. The child seating product of claim 4, wherein the tray further comprises a rotating piece having a first end that abuts the linkage and a second end that, when rotated due to lateral movement of the linkage, abuts the second latch to move the second latch inward toward the center of the tray toward an uncoupled position.

6. The child seating product of claim 1, wherein the first latch is positioned on the first frame portion and the second latch is positioned on the second frame portion, and wherein a first latch opening is positioned on a first side of the tray and a second latch opening is positioned on a second side of the tray.

7. The child seating product of claim 6, wherein the tray comprises a first plunger configured to slide laterally, wherein when the single button is depressed, the first plunger moves towards the first latch positioned within the first latch opening of the tray to push the first latch out of the first latch opening.

8. The child seating product of claim 7, wherein the tray comprises a linkage that moves away from the first latch when the single button is depressed, wherein the linkage abuts a second plunger causing the second plunger to move the second latch out of the second latch opening.

9. The child seating product of claim 1, wherein the child seating product is a wagon.

10. A child seating product comprising:

a frame having a first frame portion and a second frame portion spaced apart from the first frame portion;

a tray detachably coupled to the first frame portion and the second frame portion;

a tray decoupling mechanism comprising:

a first latch coupling the tray to the first frame portion;

a second latch coupling the tray to the second frame portion, wherein, when the tray is in a coupled configuration, the tray extends between the first frame portion and the second frame portion; and a single button on the tray that, when pushed, causes the first latch and the second latch to each move in opposite directions relative to each other, allowing the tray to uncouple from the first frame portion and the second frame portion;

wherein the first latch is releasable via a first release mechanism and the second latch is releasable via a second release mechanism, wherein the first release mechanism is different from the second release mechanism.

11. The child seating product of claim 10, wherein the first latch is positioned on a first side of the tray and the second latch is positioned on a second side of the tray, and wherein a first latch opening is positioned on the first frame portion and a second latch opening is positioned on the second frame portion.

12. The child seating product of claim 11, wherein the single button comprises a push portion and an angled portion, wherein the first release mechanism comprises depressing the push portion to cause the angled portion to slide within the first latch and move the first latch inward towards a center of the tray to an uncoupled position.

13. The child seating product of claim 12, wherein the tray comprises a linkage extending between the first latch and the second latch, and wherein inward movement of the first latch causes the second release mechanism to occur, the second release mechanism comprising:

the linkage moving laterally and abutting a first end of a rotating piece;

the first end of the rotating piece rotating to cause a second end of the rotating piece to rotate towards a wall of the second latch and push against the wall of the second latch to move the second latch inward toward the center of the tray to an uncoupled position.

14. The child seating product of claim 10, wherein the first latch is positioned on the first frame portion and the second latch is positioned on the second frame portion, and wherein a first latch opening is positioned on a first side of the tray and a second latch opening is positioned on a second side of the tray.

15. The child seating product of claim 14, wherein the tray comprises a first plunger configured to slide laterally, wherein the first release mechanism comprises depressing the single button, to cause the first plunger to move toward the first latch positioned within the first latch opening of the tray to move the first latch out of the first latch opening to an uncoupled position.

16. The child seating product of claim 15, wherein the tray comprises a linkage extending between the first latch opening and the second latch opening, and wherein actuation of the first release mechanism causes the second release mechanism to occur, the second release mechanism comprising:

the linkage moving laterally and abutting a second plunger; and the second plunger moving toward the second latch to move the second latch out of the second latch opening of the tray.

17. A child seating product comprising:

a frame having a first frame portion and a second frame portion spaced apart from the first frame portion;

a tray detachably coupled to the first frame portion and the second frame portion;

a tray decoupling mechanism comprising:

a first latch configured to detachably couple to a first latch opening, coupling the tray to the first frame portion;

a second latch positioned on the second frame portion and configured to detachably couple to a second latch opening of the tray, coupling the tray to the second frame portion, and wherein, when the tray is in a coupled configuration, the tray extends between the first frame portion and the second frame portion; and a single button on the tray that, when pushed, causes the first latch and the second latch to each move in a same direction relative to each other, allowing the tray to uncouple from the first frame portion and the second frame portion.

18. The child seating product of claim 17, wherein the first latch opening is positioned on the first frame portion, and wherein the first latch is positioned on a first side of the tray, and wherein the second latch opening is positioned on a second side of the tray.

19. The child seating product of claim 18, wherein the single button comprises a push portion and an angled portion, and when the push portion is depressed, the angled portion slides within the first latch to move the first latch inward toward a center of the tray and out of the second latch opening to an uncoupled position.

20. The child seating product of claim 19, wherein the tray further comprises a linkage that moves away from the first latch when the push portion is depressed, causing a plunger to move towards the second latch and move the second latch out of the second latch opening of the tray to the uncoupled position.

* * * * *